US005565003A

United States Patent [19]

Gerstung et al.

[11] Patent Number: 5,565,003

[45] Date of Patent: Oct. 15, 1996

[54] TUMBLING STRIP ASSEMBLY

[75] Inventors: Siegfried Gerstung; Cletus Boyd, both of Baltimore, Md.

[73] Assignee: Gym-Thing Inc., Baltimore, Md.

[21] Appl. No.: 484,328

[22] Filed: Jun. 7, 1995

[51] Int. Cl.[6] ..... A63B 5/16

[52] U.S. Cl. ..... 482/26; 482/23

[58] Field of Search ..... 482/14, 23, 26, 482/30, 32, 25, 148

[56] References Cited

U.S. PATENT DOCUMENTS

| | | | |
|---|---|---|---|
| 5,387,166 | 2/1995 | Gvoich | 482/26 |
| 5,472,390 | 12/1995 | Faye | 482/27 |

FOREIGN PATENT DOCUMENTS

| | | | |
|---|---|---|---|
| 2696102 | 4/1994 | France | 482/26 |
| 2631067 | 1/1977 | Germany | 482/26 |
| 2638968 | 3/1978 | Germany | 482/26 |
| 2839477 | 3/1980 | Germany | 482/26 |

OTHER PUBLICATIONS

Brochure of Progressive Sports and Fitness, Inc. "PSF Tumbling Tramp", (1994) pp. 1–2.

*Primary Examiner*—Lynne A. Reichard
*Attorney, Agent, or Firm*—Cushman Darby & Cushman, L.L.P.

[57] ABSTRACT

A tumbling strip including a plurality of panels, each panel having a channel defined along a centerline thereof. The plurality of panels are arranged such that the channels in each of a pair of adjacent panels are aligned with one another. A plurality of inserts are provided within the channels so that the tumbling strip has an increasing resistance to deformation as an amount of deformation of the tumbling strip increases. A fastening assembly selectively attaches adjacent panels in the plurality of panels to one another. An adjustable support assembly provides a variable amount of support for the tumbling strip so that the rebounding action of the tumbling strip can be varied depending on the amount of support provided by the adjustable support assembly.

19 Claims, 6 Drawing Sheets

TUMBLING STRIP ASSEMBLY

BACKGROUND OF THE INVENTION

1. Field of the Invention

The present invention pertains to a tumbling strip assembly, and in particular, to a tumbling strip formed by selectively attaching a plurality of panels to one another via a fastening assembly, wherein the tumbling strip provides an increasing resistance to deformation as the amount of deformation of the tumbling strip increases, and wherein a support assembly provides a variable amount of support for the tumbling strip so that the rebounding action of the tumbling strip can be varied.

2. Description of the Art

Tumbling strips for performing gymnastic exercises thereon are well known. An example of a conventional tumbling strip consists of a plurality of exercise mats secured to one another. The individual exercise mats have a substantially flat, cushion-like structure and are attached to one another so as to form a tumbling strip or runway. In this conventional tumbling strip, the plurality of attached exercise mats are laid directly on a floor or a similar rigid structure, such as a raised platform. Exercise mats having different thicknesses can be used to form the tumbling strip to provide different levels of cushioning for the gymnast.

The above-described conventional tumbling strip has several disadvantages. First, there is no resiliency or rebounding action in the conventional tumbling strip due to the cushion-like structure of the exercise mat and the exercise mat being placed directly on the floor or other solid structure. As a result, it is difficult for gymnasts lacking the skill and/or strength to execute a tumbling maneuver that requires a high degree of lifting ability to use the above-described conventional tumbling strip to execute such maneuvers.

Second, the rigid, raised platform used to support a plurality of exercise mats forming a conventional tumbling strip typically includes a plurality of separate platform members. However, it is difficult to attach the separate platform members together easily and conveniently so that the entire platform assembly can be easily and repeatedly assembled and disassembled. In addition, if the separate platforms are not strongly secured to one another, there is a danger that a gap may develop between the individual platform components.

Furthermore, when a rigid, raised platform is used, there is a danger that the tumbler may fall outside the tumbling zone defined by the exercise mats. Because the platform is raised, there in an enhanced risk of injury to any tumbler who falls outside the edge of the raised platform.

Other devices are known that provide a great deal of rebounding action. For example, trampolines, springboards and other similar structures having a very high degree of rebounding action are known. These devices enable a gymnast to practice tumbling maneuvers such as flips, jumps and turns with great ease due to their high degree of resiliency. However, trampolines and the like cannot effectively be used for practicing exercises requiring a runway or tumbling strip, such as those typically performed during a floor exercise, due to their relatively short length. Furthermore, because trampolines are very resilient, they do not provide a firm enough surface to support the gymnast during the running and take off portion of the floor exercise. As a result, the gymnast cannot achieve a proper speed and maintain the proper control necessary to perform the exercise correctly and safely.

In addition to the disadvantages discussed above, conventional tumbling strips, which include a series of exercise mats placed on the floor or on a raised platform, do not have a variable rebounding action. On the other hand, if a trampoline-like surface is used as a tumbling strip, the rebounding action can be varied, but only by adjusting the tension of the springs supporting the surface of the trampoline, which is a very difficult and time-consuming process.

SUMMARY OF THE INVENTION

It is an object of the present invention to provide a tumbling strip assembly that overcomes the problems associated with the above-described conventional tumbling strips. In this regard, it is a further object of the present invention to provide a tumbling strip that provides a firm yet resilient tumbling surface, wherein the rebounding action of the surface is adjustable, and that is easily assembled and disassembled so that it can be conveniently transported from one location to another.

In accordance with the principles of the present invention, the foregoing objects are achieved by providing a tumbling platform which includes a panel having a channel defined therein and an insert that is sized to fit within the channel in the panel. The assembled insert and panel define a tumbling platform that provides an increasing resistance to deformation as the amount of deformation of the tumbling platform increases.

For convenience of assembly and disassembly, the insert is selectively detachable from within the channel in the panel. The individual panels in each tumbling platform are selectively attached to an adjacent panel to define a tumbling strip. The selective attachment of adjacent panels in the tumbling strip is accomplished by providing a first attachment structure in a first panel in a pair of adjacent panels, and a second attachment structure in a second panel in the pair of adjacent panels. A flexible tether having a first portion located at the first attachment structure and a second portion located at the second attachment structure spans the joint between the first and second panels and, when tightened, holds the first and second panels together. In this regard, the tether is slackened when the first and second panels are disposed at an angle with respect to one another and is tightened when the first and second panels are moved such that the first panel and the second panel lie in the same plane. Thus, adjacent panels can be separated from one another by first folding the first panel relative to the second panel so that the tether is slackened and then detaching the tether from either one of the panels so that the panels are no longer joined to one another via the tether.

It is another object of the present invention to provide a tumbling strip assembly having a rebounding action that is easily and conveniently varied. This is achieved in the present invention by providing an adjustable support assembly under a tumbling strip so that the tumbling strip is able to flex as a force is applied thereto. The adjustable support assembly comprises a first support structure and a second support structure, both of which are removably inserted under the tumbling strip. The first support structure is inserted under the tumbling strip from a first side thereof and the second support structure is inserted under the tumbling strip from a second side thereof. The first and second support structures are shaped such that a increasingly greater amount of the support structures supports the tumbling strip as the support structures are further inserted under the tumbling strip. As the amount of support structure underlying the tumbling strip is varied, the rebounding action of the tumbling strip is likewise varied.

Further objects, features, and characteristics of the present invention, as well as the functions of the related elements of structure, and the economies of manufacture, will become more apparent upon consideration of the foregoing description and the appended claims with reference to the accompanying drawings, all of which form a part of the specification, wherein like reference numerals designate corresponding parts of the various figures.

DETAILED DESCRIPTION OF THE PRESENTLY PREFERRED EXEMPLARY EMBODIMENT

Figure 1:
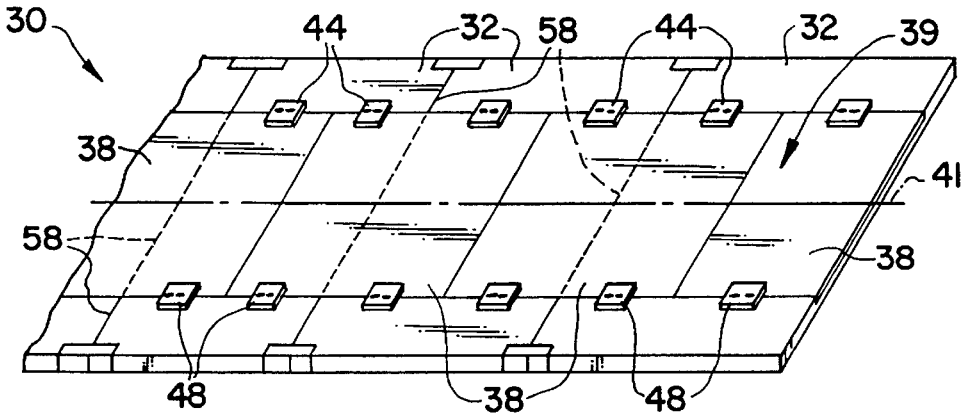
FIG. 1 is a perspective view of a tumbling strip according to the principles of the present invention.
Figure 2:
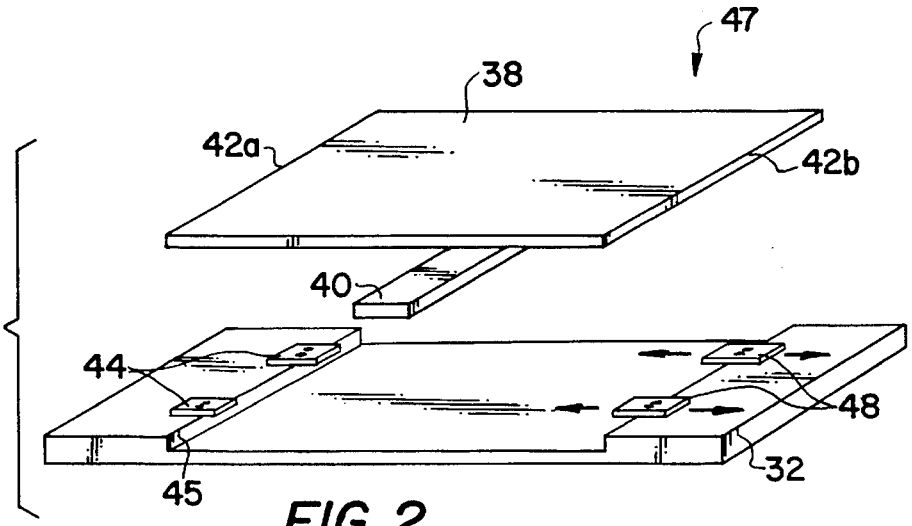
FIG. 2 is an exploded perspective view of a portion of the tumbling strip illustrated in FIG. 1.
Figure 3:
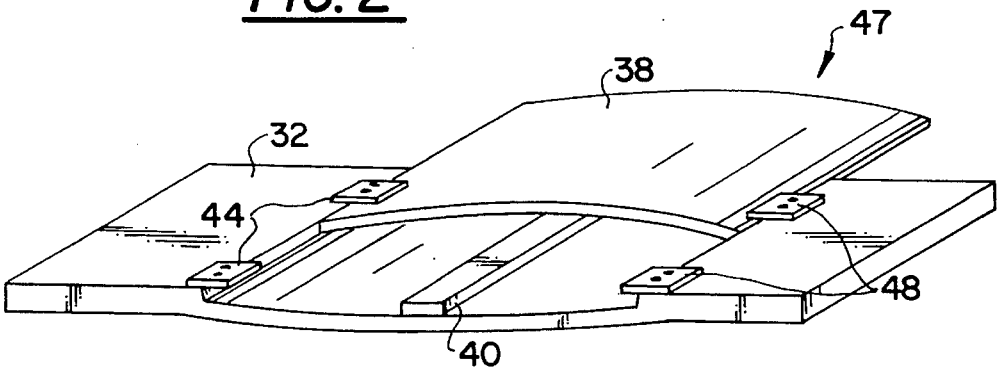
FIG. 3 is a perspective view showing in detail a tumbling platform that forms a portion of the tumbling strip illustrated in FIG. 1.

An exemplary embodiment of a tumbling strip of the present invention is discussed below with reference to FIGS. 1–5. FIG. 1 illustrates a tumbling strip, generally indicated at 30, that is both resilient and firm. In the illustrated embodiment, tumbling strip 30 includes a plurality of panels 32 arranged in a side-by-side abutting relation. As shown in FIGS. 2, each panel 32 includes a channel 34 defined along a centerline 36 thereof. An insert 38 is sized so as to fit within channel 34 as shown in FIG. 3. A spacer 40 is provided between insert 38 and panel 32. The size of insert 38 is such that insert 38 and/or panel 32 is slightly deformed when insert 38 is provided within channel 34. Spacer 40 ensures that insert 38 bows away from panel 32 and that panel 32 bows away from insert 38, i.e., insert 38 and panel 32 flex relative to one another.

Figure 5:
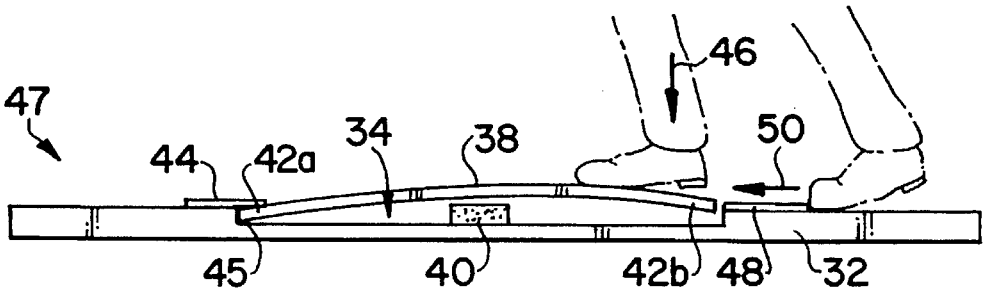
FIG. 5 is a side view showing the manner in which the tumbling strip illustrated in FIG. 1 is assembled.

Insert 38 and panel 32 are assembled as illustrated in FIG. 5. First, an end portion 42*a* on one side of insert 38 is inserted so that it abuts a wall 45 of channel 34 and slides under a fastening block 44. In the illustrated embodiment, fastening block 44 is fixed to panel 32. However, it is to be understood that fastening block 44 can be slidably attached to panel 32. Spacer 40 is provided between panel 32 and insert 38, and the other end portion 42*b* of insert 38 is bent down over spacer 40 by applying a force on end portion 42*b* of panel 38 as shown by arrow 46 in FIG. 5. Once insert 38 is sufficiently deflected so that end portion 42*b* fits within channel 34 of panel 32, a slidable fastening block 48 is slid over the end of panel 32, as shown by arrow 50 in FIG. 5. In this manner, panel 32 and insert 38 together define a tumbling platform, generally indicated at 47, which is maintained in a tensioned or flexed condition. The completed structure for the tumbling platform is illustrated in FIG. 3.

Because insert 38 is made from a material that tends to return to its original position once deflected, bending insert 38 so that it fits within channel 34 causes insert 38 to impart a force on the walls of channel 34. This force creates a tensile force in panel 32, tending to cause the wall of channel 34 to move away from one another. Conversely, the walls of channel 34 impart a compressive force on insert 38, tending to cause the ends of insert 32 to move toward on another. Thus, providing insert 38 in channel 34 preloads the tumbling platform.

A plurality of panels 32 and inserts 38, i.e. tumbling platforms 47, are assembled as illustrated in FIG. 1 to form tumbling strip 30. In the illustrated embodiment, the panels 32 are arranged in a side-by-side abutting relation such that the channel defined in each panel is aligned with the channel in an adjacent panel thereby forming a continuous channel, generally indicated at 39, along a the length of tumbling strip 30 parallel to centerline 41 of tumbling strip 30. Inserts 38 are provided within the continuous channel, as discussed above with respect to FIGS. 3 and 5 and including spacers 40, such that the inserts overlap joints 58 between adjacent panels 32. This arrangement provides a tumbling strip having greater structural integrity than a tumbling strip wherein the inserts do not overlap the joints between adjacent panels.

The advantage of assembling insert 38 within channel 34 in panel 32 with spacers 40 therebetween so that the insert and panel are preloaded with tensile and/or compressive forces is that the tumbling platform comprising the insert and panel so assembled has a greater strength and firmness than a tumbling platform made up of a single piece of material. In addition, this arrangement for the insert and panel allows the tumbling platform to become increasingly firmer as it is flexed downward. That is, the resistance to deformation of the tumbling platform increases as the amount of deformation of the tumbling platform increases.

Figure 4:
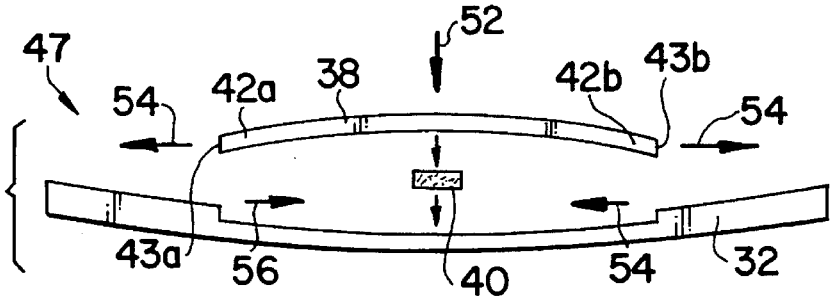
FIG. 4 is an exploded side view of a tumbling platform showing the forces interacting on the elements of the tumbling strip illustrated in FIG. 1.

These advantageous features of the present invention are described below with references to FIG. 4. As shown in this figure, a downward force indicated by arrow 52 causes insert 38 to flatten out thereby applying an outward force extending from the edges 43*a* and 43*b* of panel 32 as indicated by arrows 54 in FIG. 4. At the same time, downward force 52 is translated to panel 32 via spacer 40 so that panel 32 bows away from spacer 40. As the amount of deflection in panel 32 increases, a compressive force, as indicated by arrows 56 in FIG. 4, is generated. The interaction of outwardly extending forces 54 and compressive force 56 causes the tumbling platform to become increasingly firmer as the downward force 52 increases. Thus, the tumbling platform provides a greater resistance a force that causes a downward deflection as the amount of downward deflection caused by that force increases. This enables the tumbling platform to recover from a deflected position faster than a tumbling platform made from a single piece of material. As a result, a tumbling strip including the above described tumbling platforms provides a relatively faster recovery time for heavier and more powerful tumblers and provides a springier floor for lightweight and less powerful tumblers.

Panel 32 and insert 38 are made from a material that is both rigid and flexible. In an exemplary embodiment of the present invention, panel 32 and insert 38 are made from plywood. Panel 32 is made by attaching two strips of plywood on respective side of a sheet of plywood so that channel 34 is defined therebetween. Spacer 40 can also be made from a variety of materials. Examples of suitable materials include a rigid or semi-rigid foam strip, a spring-like member, and any solid material that can withstand compressive forces. Fastening blocks 44 and 48 are made from any material having sufficient strength and durability to effectively hold insert 38 in channel 34 of panel 32, such as brass or steel.

Figure 6:
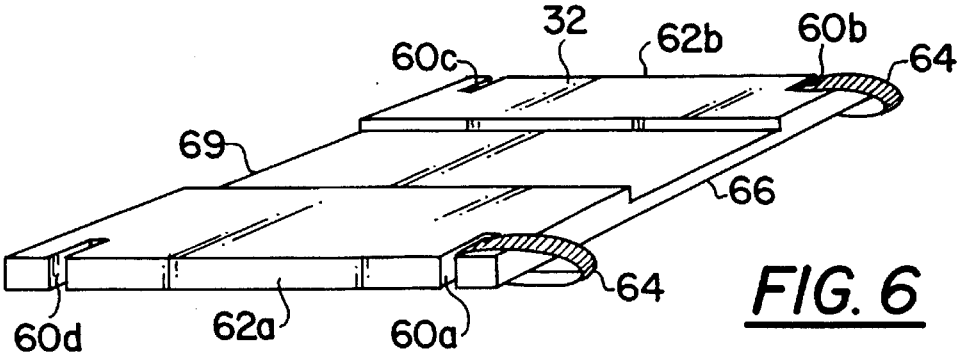
FIG. 6 is a perspective view showing the structure used to attach adjacent panels of the tumbling strip illustrated in FIG. 1 to one another.

The manner in which adjacent panels 32 are attached to one another is described below with reference to FIGS. 1 and 6, 7, and 8(*a*)–8(*b*). As shown in FIG. 6, each panel 32 includes slots 60*a*–60*d* defined in peripheral edge portions thereof. Slots 60*a*–60*d* extend from edges 62*a* and 62*b* of each panel 32 toward a central portion of the panel. One slot is provided in each corner of the panel. Slots 60*a*–60*d* serve as attachment structures for attaching a first panel 32*a* to a second panel 32*b* in a pair of adjacent panels. See FIGS. 7 and 8*a*–8*b*. A tether 64 is affixed within slots 60*a* and 60*b* provided proximate to a side 66 of first panel 32*a*. Side 66 of first panel 32*a* is proximate to a side 67 of second panel 32*b* when first and second panels 32*a* and 32*b* are attached. In the illustrated embodiment, tether 64 is a strap made out of fabric such as that used in a vehicle seat belt. The other slots 60*c* and 60*d* in panel 32 are used to attach another panel (not shown) to side 69 of panel 32.

Figure 7:
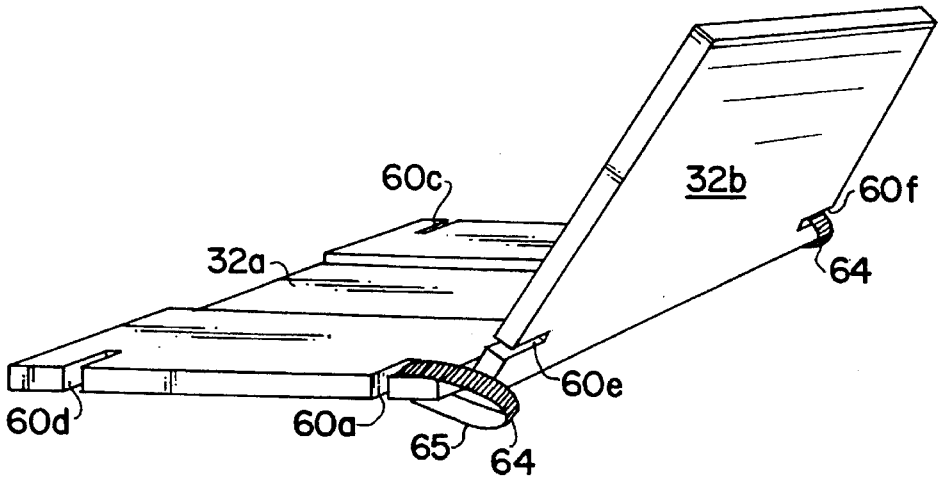
FIG. 7 is a perspective view showing the manner in which a pair of adjacent panels in the tumbling strip illustrated in FIG. 1 are attached to one another according to the principles of the present invention.
Figure 8A:
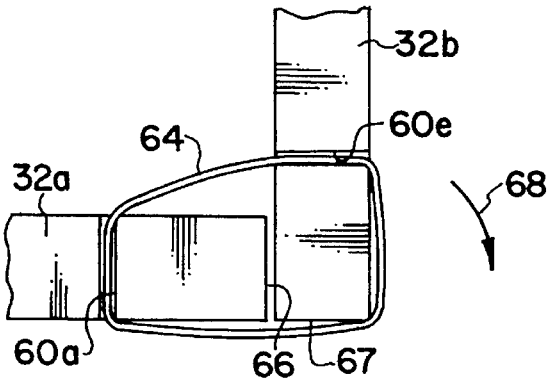
FIGS. 8*a* and 8*b* are front views illustrating the manner in which a strap joining adjacent panels in the tumbling strip illustrated in FIG. 1 is tightened.
Figure 8B:
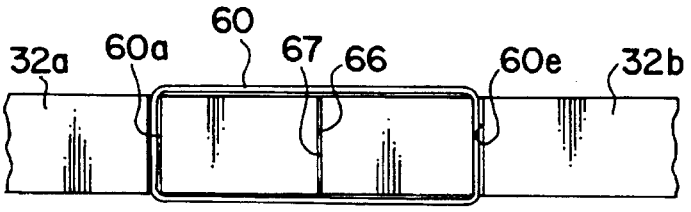
Figure 9:
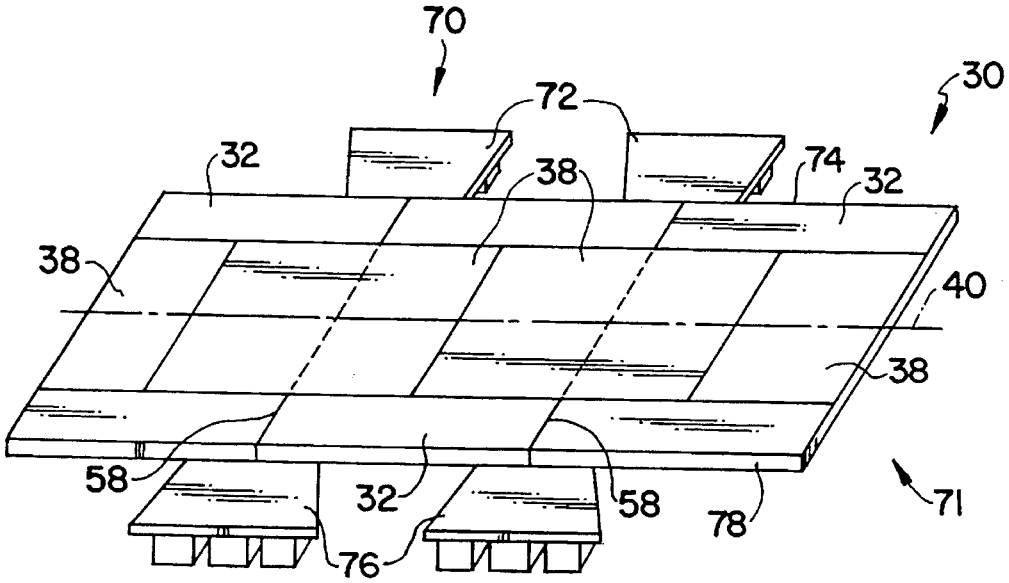
FIG. 9 is a perspective view of a tumbling strip assembly including an adjustable support assembly on which the tumbling strip illustrated in FIG. 1 is supported.

The manner in which strap 64 attaches adjacent panels to one another is illustrated in FIGS. 7 and 8*a*–8*b*. As shown in FIG. 7, a first panel 32*a* is arranged adjacent a second panel 32*b* such that sides 66 and 67 of first and second panels 32*a* and 32*b*, respectively, are proximate to one another. A free end of strap 64, which is formed in a loop, is inserted into a first slot 60*e* in second panel 32*b*. Slots 60*a* and 60*e* are arranged such that when first panel 32*a* and second panel 32*b* are at an angle with respect to one another, as shown in FIG. 7 and FIG. 8*a*, tether 64 fits easily into slots 60*a* and 60*e* and is slackened. Slots 60*a* and 60*e* are also located in first and second panels 32*a* and 32*b* such that when second panel 32*b* is moved so that first and second panels 32*a* and 32*b* lie in the same plane, as shown by arrow 68 in FIG. 8, tether 64 is tightened thereby securing first panel 32*a* to adjacent second panel 32*b*.

This arrangement of slots and straps makes assembly and disassembly of the tumbling strip easy and convenient. While straps 64 are described above as being attached in one of the slots in panel, it is to be understood that strap 64 need not be permanently affixed in either slot. However, by affixing strap 64 in one of the slots in the pair of adjacent panels, it is less likely that strap 64 will be lost. In addition, attaching straps 64 to panel 32 provide a handle for carrying the panel when the panel are disassembled.

While the attachment of two panels has been described above, it is to be understood that additional panels can be attached to these two attached panels, or other panels, in a similar manner to form a series of attached tumbling platforms that define a tumbling strip.

Referring now to FIGS. 9–13*b*, an adjustable support assembly on which the assembled tumbling strip described above is placed to form a completed tumbling strip assembly, generally indicated at 71, will be described below. The adjustable support assembly, generally indicated at 70, includes a first support structure 72 removably inserted under at least one panel 32 in tumbling strip 30 such that at least a portion of first support structure 72 supports tumbling strip 30. In the illustrated embodiment, first support structure 72 is provided at a first side 74 of tumbling strip 30 such that joint 58 between adjacent panels overlaps first support structure 72. Similarly, a second support structure 76 is provided at a second side 78 of tumbling strip 30 such that at least a portion of second support structure 76 underlies tumbling strip 30. Providing the first and second support structures 72 and 76 at joints 58 enhances the structural integrity of tumbling strip assembly 71.

Figure 10:
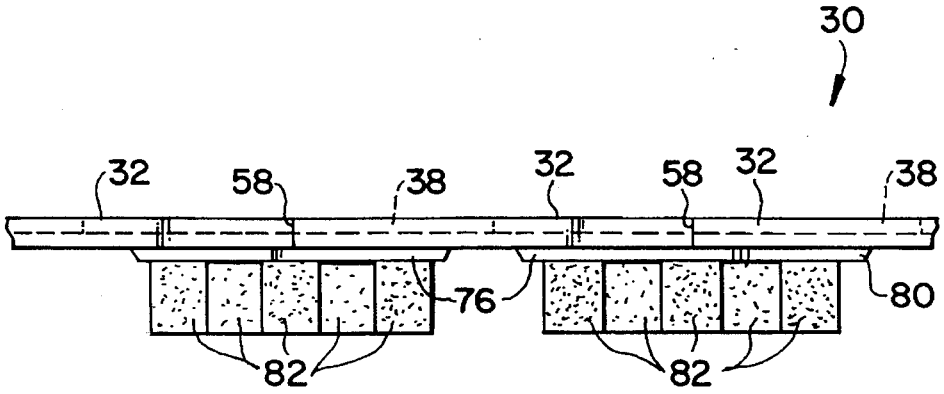
FIG. 10 is a front view of the tumbling strip assembly illustrated in FIG. 9.
Figure 11:
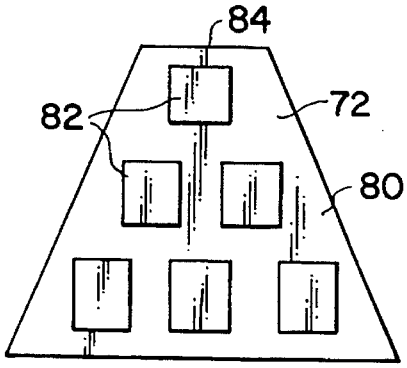
FIG. 11 is a bottom view of an individual support structure in the adjustable support assembly illustrated in FIG. 9.

As shown in FIGS. 10 and 11, each support structure 72 and 76 is formed for a triangular shaped base portion 80 having a first surface that is proximate to tumbling strip 30 when the support structure is inserted thereunder and second surface having a plurality of block members 82 attached thereto. Base member 80 can be made from any material strong enough to support tumbling strip 30, such a plywood. Blocks 82 can be formed from any material, however, in a preferred embodiment of the preferred invention, blocks 82 are formed of EVA or EPT foam.

Figure 12A:
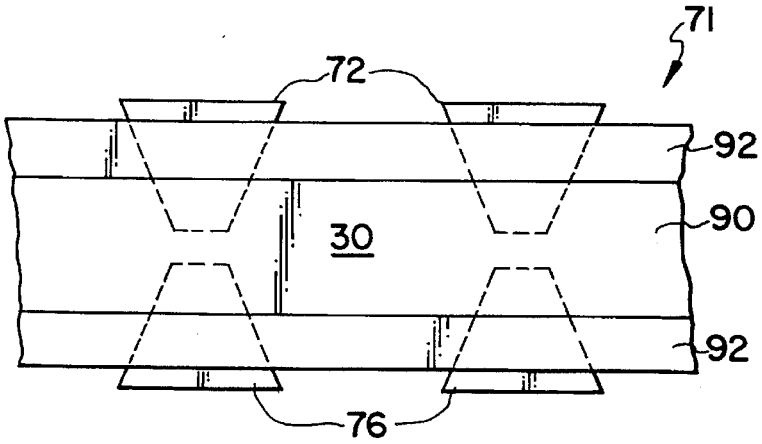
FIGS. 12*a* and 12*b* are plan views of a tumbling strip assembly illustrating various positions for the support structures that provide different levels of support for a tumbling strip.
Figure 12B:
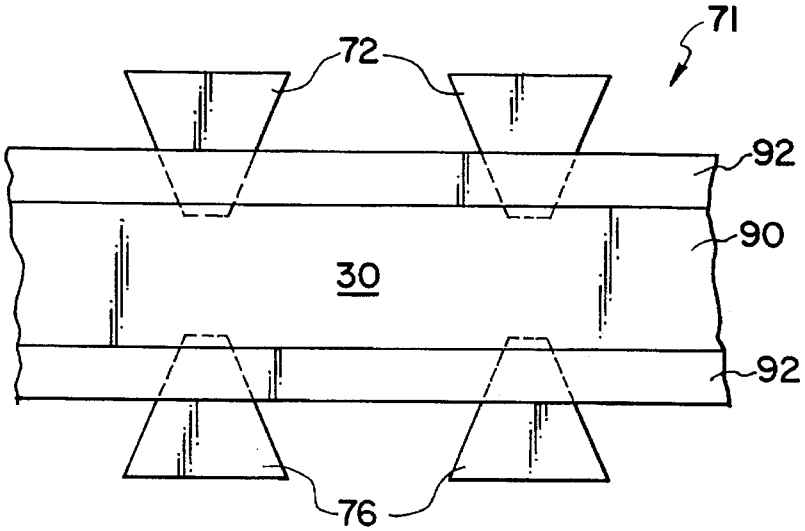
Figure 13A:
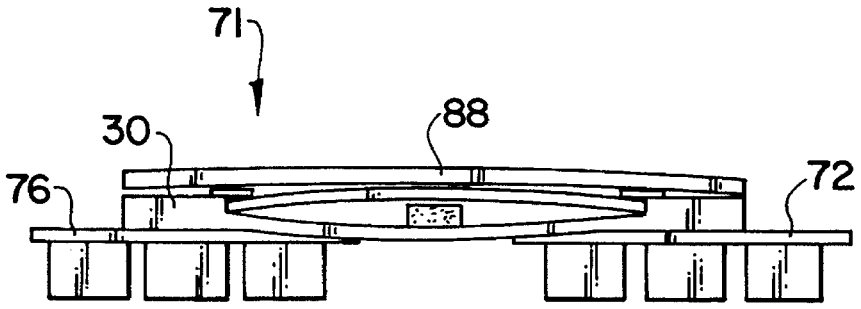
FIGS. 13*a* and 13*b* are side views of the tumbling strip assembly illustrated in FIGS. 12*a* and 12*b*, respectively.
Figure 13B:
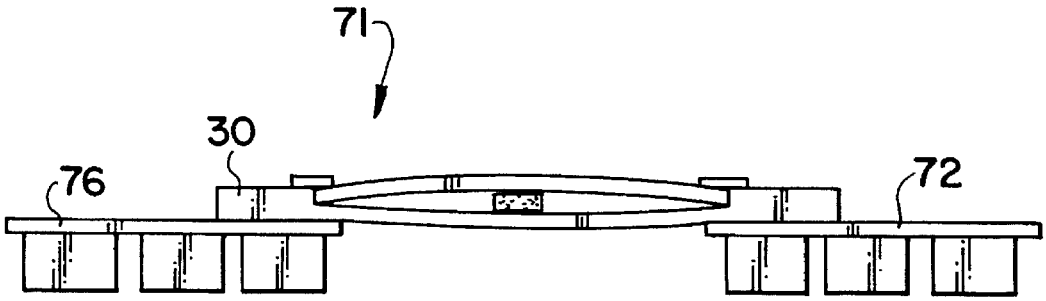

First and second support structures 72 and 76 are removably inserted underneath tumbling strip 30 so that the amount of the support structure underlying the tumbling strip can be varied. Depending on the amount of support provided by the support structures, the rebounding action of the tumbling strip can be controlled. The triangular shape of the support structures, wherein the support structures are inserted under the tumbling strip such that a peak 84 of the triangular member is proximate to the centerline 41 of tumbling strip 30, provides a greater amount of support for the tumbling strip as the amount of support structure inserted under tumbling strip 30 increases. Examples of different degrees of insertion of the support structures under tumbling strip 30 are illustrated in FIGS. 12*a*–13*b*. FIGS. 12*a* and 13*a* illustrate examples of the support structures 72 and 76 fully inserted under tumbling strip 30. When inserted in this fashion, the rebounding action of the tumbling strip is minimized so that there is less bending of the tumbling strip when a force is applied thereon. FIGS. 12*b* and 13*b* illustrate the insertion of support structure 72 and 76 that provides a minimal amount of support for tumbling strip 30. This arrangement for support structure 72 and 76 allows tumbling strip 30 to have the greatest amount of rebounding action so that slower and deeper strokes of the tumbling strip result when a downward force is applied thereon. Thus, it is possible to adjust the rebounding action of the tumbling strip by merely altering the placement of support structures 72 and 76. In addition, the outrigger type configuration of adjustable support assembly 70, wherein support structures 72 and 76 extend out from underneath tumbling strip 30, provides additional stability and support for tumbling strip assembly 71.

As shown in FIG. 13*a*, padding 88 of any suitable thickness can be provided on the exposed surface of tumbling strip 30 to provide a safe tumbling surface for the gymnast. Padding 88 covers joints between inserts as well as fastening blocks 44 and 48. In another embodiment of the present invention, support structures 72 and 76 are covered with a cushioning material so that an additional soft landing area is provided in the event the gymnast falls outside the landing area defined by tumbling strip 30. In yet another embodiment of the present invention, padding 88 includes markings that identify a runway 90 along the center of the tumbling strip and edges 92 of the tumbling strip so that the gymnast can quickly and easily determine his or her orientation on the tumbling strip. See FIG. 12*a* and 12*b*.

While the present invention has been described in conjunction with what is presently considered to be the most practical preferred embodiment, it is to understood that the invention is not to be limited to the disclosed embodiments, but on the contrary, is intended to cover various modifications and equivalent arrangements included within the spirit and scope of the appended claims.

What is claimed is:

1. A tumbling strip comprising:

at least one panel having a first surface portion, a second surface portion opposite said first surface portion, and a channel defined at said first surface portion, said channel having a surface facing generally a same direction as said first surface portion of said at least one panel;

at least one insert having a first surface portion and a second surface portion opposite said first surface portion, said at least one insert being selectively disposed within said channel such that said first surface portion of said at least one insert generally faces said surface of said channel and such that an assembled insert and panel define a tumbling platform, said first surface of said panel and said second surface of said insert defining an exposed surface of said tumbling platform, said at least one insert being sized relative to a width of said channel such that said tumbling platform provides an increasingly greater resistance to deformation caused by a force applied to said exposed surface of tumbling platform as an amount of said deformation of said tumbling platform increases.

2. A tumbling strip as defined in claim 1, wherein said tumbling strip further comprises a spacer provided between said first surface of said at least one insert and said surface of said channel.

3. A tumbling strip as defined in claim 1, further comprising a fastening member operatively coupled to one of said at least one panel and said at least one insert, said fastening member removably attaching said at least one insert within said channel of said at least one panel.

4. A tumbling strip as defined in claim 1, wherein, in said tumbling platform, said at least one insert imparts a load on said at least on panel.

5. A tumbling strip as defined in claim 1, wherein a plurality of said panels are arranged such that said channels in said plurality of panels define a continuous channel along a length of said tumbling strip, and wherein a plurality of said inserts are positioned within said continuous channel such that at least one insert overlaps a joint between adjacent panels in said plurality of panels.

6. A tumbling strip as defined in claim 5, further comprising a fastening assembly for selectively attaching a pair of adjacent panels in said plurality of panels, said fastening assembly being operatively coupled to at least one of a first panel in said pair of adjacent panels and a second panel in said pair of adjacent panels.

7. A tumbling strip as defined in claim 6, wherein said fastening assembly comprises:

a first attachment structure operatively coupled to said first panel in said pair of adjacent panels;

a second attachment structure operatively coupled to said second panel in said pair of adjacent panels;

a flexible tether having a first portion operatively coupled to said first attachment structure and a second portion operatively coupled to said second attachment structure so that said tether spans said joint between said first panel and said second panel, said first attachment structure and said second attachment structure being provided at a portion of said first panel and a portion of said second panel, respectively, such that said tether is slackened when said first panel and said second panel are disposed in separate intersecting planes, and said tether is tightened when said first panel and said second panel are located in a same plane.

8. A tumbling strip as defined in claim 7, wherein said first attachment structure includes a first slot defined at an edge portion of said first panel, and wherein said second attachment structure includes a second slot defined at an edge portion of said second panel.

9. A tumbling strip as defined in claim 8, wherein said first slot extends from an exposed edge of said first panel through a thickness of said first panel and said second slot extends from an exposed edge of said second panel through a thickness of said second panel, said first slot and said second slot being located on a same side of said tumbling strip, and wherein said tether is a strap disposed in a loop and provided within said first slot and said second slot.

10. A tumbling strip as defined in claim 8, wherein said strap is affixed within one of said first slot and said second slot so that said pair of adjacent panels are detached from one another by removing said strap from within another of said one of said first slot and said second slot.

11. A tumbling strip as defined in claim 1, further comprising an adjustable support assembly providing a variable amount of support for said tumbling platform so that a rebounding action of said tumbling platform is variable depending on an amount of support provided by said adjustable support assembly.

12. A tumbling strip as defined in claim 11, wherein said support assembly comprises:

a first support structure removably inserted under said tumbling platform from a first side thereof such that a portion of said first support structure supports said tumbling platform; and a second support structure removably inserted under said tumbling platform from a second side thereof such that a portion of said second support structure supports said tumbling platform, said tumbling platform spanning between said first support structure and said second support structure.

13. A tumbling strip as defined in claim 12, wherein said first support structure and said second support structure are triangular-shaped and are inserted under said tumbling platform such that a peak of said first support structure and a peak of said second support structure are proximate to a centerline of said tumbling platform.

14. A tumbling strip as defined in claim 13, wherein said first support structure and said second support structure each includes:

a triangular-shaped base portion having a first surface and a second surface opposite said first surface, said first surface being positioned proximate to said second surface of said panel in said tumbling platform and; and a plurality of block members affixed to said second surface of said triangular-shaped base portion.

15. A tumbling strip as defined in claim 14, wherein said plurality of block members in each of said first support structure and said second support structure are positioned on said second surface of said triangular-shaped base portion such that a number of blocks spanning a width of said triangular-shaped base portion increases as a distance from a peak of said triangular-shaped base portion increases.

16. A tumbling strip assembly comprising:

a plurality of panels, each panel in said plurality of panels having a first surface portion, a second surface portion opposite said first surface portion, and a channel defined at said first surface portion, said channel having a surface facing in generally a same direction as said first surface of said at least one panel, said plurality of panels being arranged such that said channels define a continuous channel along a length of said tumbling strip assembly;

a plurality of inserts, each insert in said plurality of inserts having a first surface portion and a second surface portion opposite said first surface portion, each insert in said plurality of inserts being removably provided within a portion of said continuous channel, wherein a tumbling strip is defined by an assembly of said plurality of inserts and said plurality of panels and an assembly of adjacent panels attached to one another, each insert in said plurality of inserts being selectively disposed within said portion of said continuous channel such that said first surface portion of each insert generally faces said surface of said channel, said first surfaces of said plurality of panels and said second surfaces of said plurality of inserts defining an exposed surface of said tumbling strip, each of said inserts in said plurality of inserts being sized relative to a width of said continuous channel such that said tumbling strip provides an increasingly greater resistance to deformation caused by a force applied to said exposed surface of said tumbling strip as an amount of said deformation of said tumbling strip increases;

a fastening assembly for selectively attaching a pair of adjacent panels in said plurality of panels to one another, said fastening assembly being operatively coupled to at least one of a first panel in said pair of adjacent panels and a second panel in said pair of adjacent panels; and an adjustable support assembly providing a variable amount of support for said tumbling strip so that a rebounding action of said tumbling strip is variable depending on an amount of support of said tumbling strip provided by said adjustable support assembly.

17. A tumbling strip assembly as defined in claim 16, wherein said adjustable support assembly comprises:

a first support structure removably inserted under a first side of said tumbling strip such that a portion of said first support structure supports said tumbling strip, and a second support structure removably inserted under a second side of said tumbling strip such that a portion of said second support structure supports said tumbling strip; and wherein said fastening assembly comprises:

a first attachment structure operatively coupled to said first panel in said pair of adjacent panels, a second attachment structure operatively coupled to said second panel in said pair of adjacent panels, and a flexible tether having a first portion operatively coupled to said first attachment structure and a second portion operatively coupled to said second attachment structure so that said tether spans a joint between said first panel and said second panel, wherein said first attachment structure and said second attachment structure are located at portions of said first panel and said second panel, respectively, such that said tether is slackened when said first panel and said second panel are disposed in separate intersecting planes, and said tether is tightened when said first panel and said second panel are located in a same plane.

18. A tumbling strip assembly as defined in claim 17, wherein said first support structure and said second support structure are triangular-shaped and are inserted under said tumbling strip such that a peak of said first support structure and a peak of said second support structure are proximate to a centerline of said tumbling strip, wherein said first attachment structure includes a first slot defined at an edge portion of a first panel, and wherein said second attachment structure includes a second slot defined at an edge portion of said second panel.

19. A tumbling strip as defined in claim 18, wherein said first slot extends along an exposed edge of said first panel through a thickness of said first panel and said second slot extends along an exposed edge of said second panel through a thickness of said second panel, said first slot and said second slot being located at a same side of said tumbling strip, and wherein said tether is a strap disposed in a loop and provided within said first slot and said second slot.

* * * * *